US008033225B2

(12) United States Patent
Friede et al.

(10) Patent No.: US 8,033,225 B2
(45) Date of Patent: Oct. 11, 2011

(54) DISPENSER SYSTEM FOR DISCHARGING COUNTERMEASURE MEANS

(75) Inventors: Johan Friede, Skokloster (SE); Christer Hedberg, Saltsjö-Boo (SE); Christer Zätterqvist, Uppsala (SE)

(73) Assignee: Saab AB, Linköping (SE)

( * ) Notice: Subject to any disclaimer, the term of this patent is extended or adjusted under 35 U.S.C. 154(b) by 226 days.

(21) Appl. No.: 12/261,594

(22) Filed: Oct. 30, 2008

(65) Prior Publication Data

US 2009/0120955 A1 May 14, 2009

(30) Foreign Application Priority Data

Oct. 30, 2007 (EP) ..... 07119587

(51) Int. Cl.
*B64D 1/02* (2006.01)

(52) U.S. Cl. ..... 102/505

(58) Field of Classification Search ..... 102/505, 102/340, 342, 334, 504; 89/1.51; 244/1 TD, 244/136
See application file for complete search history.

(56) References Cited

U.S. PATENT DOCUMENTS 2,954,948 A * 10/1960 Johnson ..... 244/136
3,511,457 A * 5/1970 Pogue ..... 244/137.3
4,304,517 A * 12/1981 Ulin ..... 342/12
4,309,705 A * 1/1982 Ulin ..... 342/12
4,650,092 A 3/1987 Andersson et al.
5,018,249 A * 5/1991 Andersson et al. ..... 221/222
5,220,124 A * 6/1993 Pennington et al. ..... 89/1.51
6,539,833 B1 * 4/2003 Zatterqvist ..... 89/1.51
6,666,351 B1 * 12/2003 Hartz et al. ..... 221/258
2004/0200381 A1 * 10/2004 Zatterqvist ..... 102/505

FOREIGN PATENT DOCUMENTS

EP 0127218 A1 12/1984
EP 0506634 A1 9/1992

OTHER PUBLICATIONS

European Search Report—Mar. 12, 2008.

* cited by examiner

*Primary Examiner* — Bret Hayes
*Assistant Examiner* — Reginald Tillman, Jr.
(74) *Attorney, Agent, or Firm* — Venable LLP; Eric J. Franklin

(57) ABSTRACT

A dispenser system for a platform. The dispenser system is configured to be mounted to the platform and connected to power- and control-system of the platform. The dispenser system includes a dispenser for countermeasure boxes. The dispenser is configured for non-pyrotechnic dispensing and opening of the boxes. Each box is sealed by a detachable closure that includes a first opening member and at least one passive, second opening member stationarily fixed to the dispenser, which is provided with a motor gear. The first and second opening members are configured for detaching the closure by mutual interaction simultaneously as each box under the influence of the motor gear is launchable from the dispenser.

11 Claims, 1 Drawing Sheet

DISPENSER SYSTEM FOR DISCHARGING COUNTERMEASURE MEANS

CROSS-REFERENCE TO RELATED APPLICATIONS

This application claims priority to European patent application 07119587.9 filed 30 Oct. 2007.

BACKGROUND OF THE INVENTION

1. Technical Field of the Invention

The present invention relates to onboard non-pyrotechnic dispensers for a platform, for example an aircraft, a naval vessel, a land vehicle etc. for discharging counter-measure means combining in a single device a plurality of non-pyrotechnic boxes which can be launched in succession, for example to launch flares or chaff such as infrared decoys or radar reflecting chaff.

More particularly, the invention relates to a dispenser system for a platform, configured to be mounted to said platform and connected to its power- and control-systems, comprising a dispenser for countermeasure boxes, said dispenser being configured for non-pyrotechnic dispensing and opening of each box.

2. Description of Related Art

One category of said dispensers includes electro mechanical dispensers for launching portion packs of above all heat-generating and radar-reflecting counter-measure enclosed in boxes, which subsequently are opened to spread the countermeasure. The opening of said boxes can be executed by means of wind induced forces or a separate opening mechanism.

Several disadvantages are associated with a box opened by wind induced forces. There is a minimum speed below which wind induced forces become too small to open the box. The box tends to become complex and expensive. The content will not be spread as rapidly as if the box be instantly opened during its launching.

If the box is not opened at all or opened to late, due to manufacturing failure or too low an air speed, it might hit the fuselage or aircraft structure and thereby cause damages.

It is therefore desirable to take benefit of a separate opening mechanism. Conventionally, such a dispenser might involve a device for the ejection of chaff boxes attached to each other through the exit of a container. For example EP-B1-0127218 discloses that in order to eject and open the chaff boxes gear wheels engage with peripherally located gears on the boxes such, that the box situated closest to the exit is completely released from the boxes lying behind and is given a push out of the container during a subsequent rotation of said gear wheels.

As the boxes are attached to each other such, that each box is closed by the bottom plate of an adjacent box, the separation and pushing out of the box closest to the exit also will induce an opening of said box.

SUMMARY OF THE INVENTION

It is an object of the present invention to provide a reliable dispenser system with improved capacity to weight ratio and which is uncomplicated, easier to load and reload and less expensive than conventional dispensers.

This is possible by means of a dispenser system and method. Advantageous embodiments, improvements and developments appear from the following description.

ADVANTAGES

Automatic opening during dispensing reduces the minimum allowed air speed during which dispensing can occur effectively as compared to opening by means of aerodynamically induced forces. This allows for new applications on slow moving vehicles like helicopters, naval vessels and land vehicles.

Automatic opening increases somewhat the complexity of the dispenser system but decreases at the same time the complexity of the non-pyrotechnic boxes thus reducing the life cycle cost as more boxes than dispenser system are made.

The dispersion of the contents of each box after dispensing of the same will occur earlier with the automatically opened boxes than with boxes opened by aerodynamically induced forces, as the aerodynamic interaction occurs after the dispensing.

The automatic opening, being positive in the sense that no boxes are allowed to be dispensed without being opened, reduces to nothing the probability that the box is a dud. This is advantageous both from an effectiveness viewpoint and from a debris standpoint, since unopened boxes may represent a significant mass which may cause damage to the structure, e.g. an aircraft wing leading edge, surrounding the dispenser system.

Further, the automatic and positive opening enables an instant dispersion of the contents of each box after dispensing of the same, which will likewise result in an instant flaring up of the content, which accordingly can exert its protective effect for a longer time and earlier than conventionally, before it leaves the field of view of a homing device.

The invention will be described in more detail below with reference to the accompanying drawing.

DESCRIPTION OF A PREFERRED EMBODIMENT OF THE INVENTION

Figure 1:
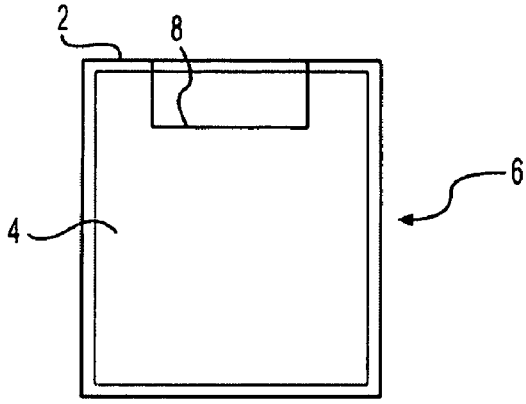
FIG. 1 is a plan view of a non-pyrotechnic counter-measure box provided with a detachable closure.

FIG. 1 is a plan view of a non-pyrotechnic counter-measure container 2 for use in the dispenser system according to the invention. Said container 2 is filled with counter-measure as heat-generating, radar-reflecting, laser-reflecting or other materials and is used for keeping and storing said material up to its launching from a dispenser 3. In case of heat-generating counter-measure it is an imperative necessity the container be air-tight, possibly filled with inert gas or vacuum in order to prevent a premature degeneration of the heat-generating material.

Advantageously, the container might be configured by means of an air-tight container 2 of for example plastics or biodegradable materials, one side of which is open and uncovered.

After being filled with counter-measure material, and possibly inert gas or vacuum, the container 2 might be covered and sealed e.g. in that an air-tight film, a plate or other barrier by welding, heat sealing or other air-tight method, on the open side of the container provides a closure 4. Hence, the container 2 sealed by means of said closure 4 constitutes a confined, air-tight box 6, one major task of which is to encase pyrophorous materials.

Figure 2:
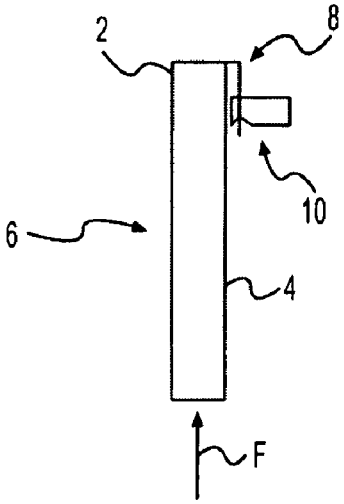
FIG. 2 shows a side view of FIG. 1, which illustrates an opening mechanism partly integrated in said box.
Figure 4:
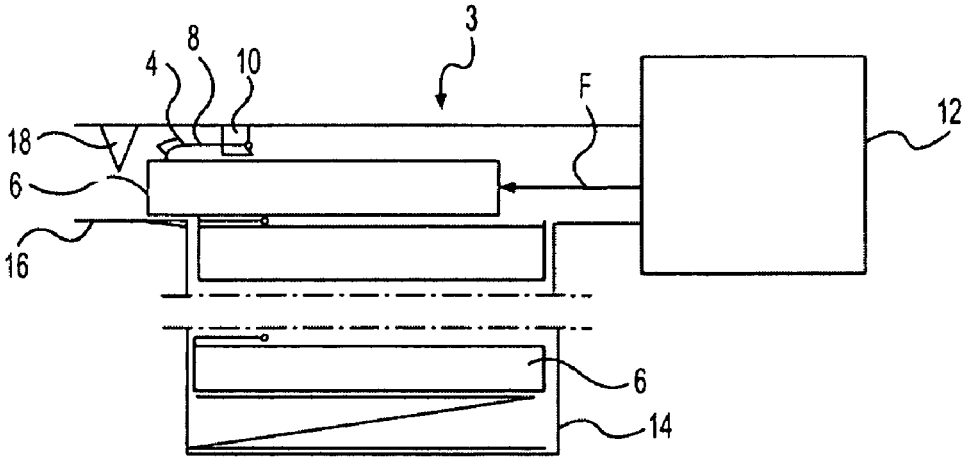
FIG. 4 illustrates part of a sequence of dispensing and opening one of a plurality of boxes.

As can be seen best in FIG. 2 and FIG. 4 said box 6 and dispenser 3 are configured with opening mechanism comprising a pad eye 8 and a hook 10 respectively or by function similar interlocking features. Said pad eye 8 is associated with the closure 4 at one end of the box 6. Said hook 10 is firmly attached to the dispenser 3 such, that it is protruding into the pad eye 8 in a loaded stand by state of the dispenser. The dispenser 3 might be provided with a mechanical/electromechanical/pneumatic-mechanical motor gear 12 of a conventional kind which will induce a force F for pushing the box 6, from a stack of boxes in a magazine 14 of the dispenser through an outlet 16 and out to the surrounding air. The force F can be generated by means of a linear- or rotary motor which can be electric or pneumatic driven. Hence, said motor gear 12 can for instance comprise a cam device in which a shaft with an eccentric cam is driven by an electric motor. The motor gear 12 is configured for generating said force F sufficiently powerful to enable the pushing out of the box 6 from the dispenser 3 simultaneously as the stationary hook 10 interacts with the pad eye 8 and thereby the box 6 when moving towards and subsequently through the outlet 16 of the dispenser causes the closure 4 to be teared off by means of pad eye 8 and hook 10.

Consequently, the content of the box 6 is free to be spread at the very moment the box is pushed out to the surrounding air regardless of the present air speed.

Figure 3:
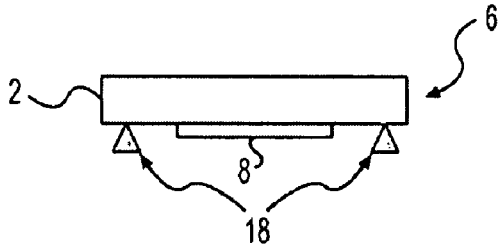
FIG. 3 illustrates an elaboration of the opening mechanism in FIG. 2

According to an advantageous development (FIG. 3 and FIG. 4) of the invention the dispenser is provided with one or more stationary knifes or cutting edges 18, which are arranged close to the side of the box which is sealed by means of the closure 4. Each cutting edge 18 is configured to cut the closure 4 open by influence of the movement of the box 6 when the latter is pushed forward out of the dispenser 3. These measures will further facilitate an instant opening of the box 6. Because the interaction between the pad eye 8 and hook 10, when the box moves through the outlet 16, will require less pushing force F, as said cutting edges 18 induce less resistance cutting the closure 4 open than the tearing off of the closure 4 without no use of cutting edges.

Accordingly, the hook 10 and knifes 18 cooperate in performing the opening operation of the box 6. The knives secure that the tearing off of the closure 4 is done in the right place and the hook secures that the closure 4 at all vanishes from the box 6.

The invention claimed is:

1. A countermeasure dispenser system, comprising:

a plurality of boxes containing countermeasures, the boxes each being sealed by a detachable closure comprising a first opening member; and a dispenser for non-pyrotechnic opening and dispensing of the boxes, the dispenser comprising a second opening member arranged to engage the first opening member on the boxes and, the dispenser further comprising a motor gear configured to move the boxes toward the second opening member, wherein the second opening member is arranged to engage and retain the first opening member to open the closure as the boxes are launched by the motor gear.

2. The dispenser system according to claim 1, further comprising:

a third opening member configured to cut the closure open.

3. The dispenser system according to claim 2, wherein the second opening member comprises a hook, wherein the third opening member comprises at least one cutting edge, and wherein the hook and the cutting edge cooperate to open the boxes.

4. The dispenser system according to claim 2, further comprising:

a platform comprising power and control systems, wherein the dispenser is mounted to the platform and connected to the power and control systems of the platform.

5. A method for distribution of countermeasures from a dispenser, the method comprising:

moving a first opening member on each of the boxes toward the a second opening member on the dispenser;

engaging and retaining the first opening member on the boxes with the second opening member; and launching the boxes from the dispenser with a force while simultaneously opening the closure of the boxes for distribution of countermeasures in surrounding air.

6. The method according to claim 5, wherein the dispenser further comprises a motor gear, and wherein the boxes are moved, launched and the boxes opened by applying a force to the boxes with the motor gear.

7. The method for distribution of countermeasures according to claim 6, further comprising:

cutting open the enclosure with a third opening member comprising at least one cutting edge on the dispenser, thereby facilitating opening of the boxes by reducing an opening resistance.

8. A countermeasure dispenser, comprising:

a dispenser for non-pyrotechnic opening and dispensing of boxes containing countermeasures and each comprising a first opening member, wherein the first opening member comprises a closure, the dispenser comprising a second opening member arranged to engage the first opening member on the boxes, the dispenser further comprising a motor gear configured to move the boxes toward the second opening member, wherein the second opening member is arranged to engage and retain the first opening member on the boxes to open the closure as the boxes are launched by the motor gear.

9. The countermeasure dispenser according to claim 8, further comprising:

a third opening member configured to cut the closure open.

10. The countermeasure dispenser according to claim 9, wherein the third opening member comprises at least one cutting edge.

11. The dispenser system according to claim 2, wherein the third opening member comprises at least one cutting edge.

* * * * *